US005465491A

United States Patent [19]

Thell

[11] Patent Number: 5,465,491

[45] Date of Patent: Nov. 14, 1995

[54] ADJUSTABLE YARDAGE PLATE

[76] Inventor: Dale G. Thell, 1606 E. Iowa, Saint Paul, Minn. 55106

[21] Appl. No.: 237,825

[22] Filed: May 4, 1994

[51] Int. Cl.[6] ..... F41G 1/467

[52] U.S. Cl. ..... 33/265

[58] Field of Search ..... 33/265; 124/87

[56] References Cited

U.S. PATENT DOCUMENTS

| | | | |
|---|---|---|---|
| 3,450,122 | 6/1969 | Diamond | 33/265 |
| 3,505,985 | 4/1970 | Helton | 33/265 |
| 3,568,323 | 3/1971 | Lendway | 33/265 |
| 4,020,560 | 5/1977 | Heck | 33/265 |
| 4,136,461 | 1/1979 | Gasser | 33/265 |
| 4,541,179 | 9/1985 | Closson | 33/165 |
| 5,092,052 | 3/1992 | Godsey | 33/265 |

OTHER PUBLICATIONS

Pages of product catalog of Koeppler (No Page #, No Date).

*Primary Examiner*—Alvin Wirthlin

*Attorney, Agent, or Firm*—Westman, Champlin & Kelly

[57] ABSTRACT

A sighting apparatus for a bow is fixedly mounted on a bow and is provided with a lever such that a sight unit is tilted as the sighting device is adjusted for longer distances so as to compensate for gravity effect on arrows. The sighting apparatus comprises a gauge which is adjustably mounted to the sighting apparatus and may be locked into an adjusted position corresponding to an arrow having alternate flight characteristics from an arrow used to calibrate the apparatus.

11 Claims, 1 Drawing Sheet

ADJUSTABLE YARDAGE PLATE

INCORPORATION BY REFERENCE

The following U.S. patent is hereby fully incorporated by reference: U.S. Pat. No. 4,541,179, entitled SIGHTING DEVICE FOR USE ON BOWS issued on Sep. 17, 1985.

BACKGROUND OF THE INVENTION

The invention relates in general to new and useful improvements in sighting devices, and more particularly to a sighting device for use on archery bows.

The bow and arrow combination has changed the course of human existence. It has provided a safer method of obtaining food, it has swung the outcome of many battles, and it has provided an enjoyable leisure time activity for those who partake in the sport of field archery.

Early humans were required to get meat at close range, attacking with knives and spears. The bow and arrow enabled the hunter to remain at a distance from his quarry so that he was less apt to become part of the hunted, thereby increasing his chances of obtaining food for those who depended on him.

The bow and arrow combination has been used as a weapon of war by many nations to defend against invaders and to offensively defeat armies on their own soil. It has helped many armies defeat forces several times as large. For example, the bow and arrow is regarded as serving an overwhelming role in the Battle of Hastings, Oct. 14, 1066, in which William of Normandy began the Norman Conquest.

Today, approximately fifty thousand years after its invention, the bow and arrow is used by over a million hunters and archers in many forms of tournament archery including Olympic events.

The bow and arrow started as a simple tool, but has evolved into a very sophisticated apparatus. An arrow generally comprises a shaft; a point attached to the front end of the shaft; a nock, or grooved piece for cooperating with the bow, attached to the rear end of the shaft; and plastic or feather fletching attached to the shaft proximate the nock. Arrow shafts are typically constructed from wood, aluminum, carbon, fiberglass, or composites of the above. Each arrow shaft material has specific characteristics regarding weight and arrow flight efficiency.

Arrow points also exist in various types. Such types include a target or field point, a blunt or roving point, a small game point, and a broadhead point. The archer chooses a point depending on the particular application, and each type of point has significantly different weight and arrow flight characteristics.

A bow typically comprises a handle, limbs and a bowstring. Sophisticated bow types are available, including long bows, recurve bows, and compound bows. The bowstring is attached to the limbs at both ends of the bow and enables the transfer of energy from the hand portion where the archer's hand draws the bowstring to the limbs of the bow. Then, when the string is released, it transfers the energy from the two limbs to the one point on the bowstring where the nock is attached. Bow strength and flexibility also correspond with arrow flight characteristics and bowstring life.

Bowstrings generally include a nockset locator to locate on the bowstring the fixed position at which the nock of each arrow engages the bowstring prior to every shot. Consistent arrow placement on the bowstring is of primary importance for achieving accuracy.

The modern bowstring is made to withstand the stress and strain placed on it by the limbs of the bow and the nock of the arrow. Nevertheless, bowstrings must be replaced and bows must be "tuned". Bow tuning refers to the process of adjusting the bow for the best performance and accuracy. Bow tuning begins with adjustments to the bowstring, fletch clearance, and nocking point. Next, the arrow must be matched to the bow to achieve good arrow flight. Finally, test shooting at close range targets and then long range targets is the final phase of bow tuning.

A majority of archers presently use bows equipped with bow sights. A bow sight, analogous to a sight on a rifle, enables the archer to more accurately orient the bow and arrow toward an intended target. Also, the use of a bow sight builds confidence and allows a novice archer to concentrate on the fundamentals of shooting. Formal target archers recognize the advantages of sights and use them extensively.

The effect of gravity on an arrow in flight is greater than the effect on a bullet traveling the same longitudinal distance because of the slower speed of the arrow. In other words, the trajectory of an arrow is much more parabolic than a bullet traveling the same distance. The trajectory of an arrow must be exaggerated when shooting at longer distance targets. Thus the distance to the target must be taken into consideration when aiming the bow and arrow. Bow sights, in order to permit accurate shooting at various distances, must be variable to accommodate the gradations in trajectory.

A common type of bow sight is adjustable to compensate for various distances from a target. The sight includes a unit that is pivotally mounted to the bow so that when the bow sight is adjusted, the sighting unit moves progressively and incrementally to compensate for the effect of gravity on the arrow. An archer judges the distance to the target, adjusts the bow sight so as to compensate for the arrow trajectory over the distance, then looks through the sight unit to the target, and shoots the bow and arrow. Although the archer is looking directly at the target through the sight unit, the bow is oriented so that the arrow is aimed to send the arrow along the appropriate parabolic path to intersect the target.

Further, the bow sight may be equipped with a gauge with various distances so that the archer need only judge the distance to the target, set the gauge to the estimated distance, look through the sight unit, and shoot the arrow.

Bow sights are accessories and are typically sold independently of the bow. Bows, as described above, come in various types and each has separate shooting characteristics. Also, the shooting characteristics of an archer varies according to the archer's height, and strength, etc. Therefore, manufacturing a gauge for a bow sight with predetermined distances for general use with various bow and arrow components to be used by various archers is most likely impossible.

Instead, a typical procedure for calibrating distances is described here. First, an archer installs a bow sight on a bow. Then the archer takes the bow to a target range, and sets the sight to an arbitrary point on the gauge. After shooting several arrows, the archer can determine (based on the distance traveled by the arrows) the precise setting for the bow sight to provide accuracy for the given distance. The archer typically places a strip of paper with an adhesive backing on the gauge, and writes or marks on the paper the distance to correspond with the distance traveled by the arrows. Thus, in the future, if the archer sets the sight to the mark on the adhesive paper and aims the bow and arrow through a sight unit, the arrow will hit a target at the distance marked on the gauge.

Once the bow is properly sighted for the first distance, the archer sights the bow for a second distance. The archer arbitrarily adjusts the sight again, shoots another set of arrows while looking through the sight, determines the distance traveled by the arrows, fine tunes the sight setting, and writes or marks on the paper to indicate the proper sight setting to ensure accuracy at the second distance. This laborious process is repeated until the archer has a suitable number of marks on the paper to correspond with various distances.

One disadvantage of this method is that use of the bow sight outdoors causes damage to the adhesive paper. The elements cause the paper to tear or wrinkle and the marks to smear. Once the adhesive becomes damaged, it must be peeled away from the gauge, and another piece of adhesive paper must be attached to the gauge and recalibrated by the laborious process described above.

The paper must also be peeled from the gauge and the gauge recalibrated if the bowstring is replaced, the bow sight or the nocking point is adjusted, or if the bow is retuned. Completely peeling the paper from the gauge is often difficult.

Another disadvantage of this method is that the paper gauge is only calibrated to correspond with distances of the arrows shot during the calibration process. As described above, different type shafts and, more importantly, different type points cause the arrow to have significantly different trajectories. Thus, the distances marked on the paper gauge only correspond with arrows having the same shafts and points used during the calibration process.

A second sighting method involves the use of small removable yardage indication stickers. Such stickers are cumbersome and difficult to place accurately. Further, with the advent of extremely high powered bows, the stickers must be placed so close together they either overlap one another or are formed with impractically small dimensions.

SUMMARY OF THE INVENTION

The present invention arises from the realization that there exists a need for a bow sight with a calibrated gauge that can easily be adjusted to correspond with the flight characteristics of different arrow components used by the archer. Also, the calibrated gauge must withstand the elements. Finally, the gauge must be easily replaceable and/or adjustable in the event of retuning, change in nock points, adjusting the bow sight, or the like.

The present invention is directed to a device that satisfies the need for an archery bow adjustable bow sight with a removable gauge that may be adjusted to correspond with the use of arrows having different components, the gauge being able to withstand the elements, and the gauge being easily replaced or recalibrated when necessary. The device comprises a bow sight having a support which is attached to the archery bow. A gauge is attached to the support. An adjustable lever is pivotally mounted to the support. The lever has a sight unit on one end and a pointer on the other. The pointer cooperates with the gauge to indicate the distance to the target sighted in the sight unit. The bow sight also has means for locking the gauge in an adjusted position.

BRIEF DESCRIPTION OF THE DRAWINGS

These and other features, aspects, and advantages of the present invention will become better understood with regard to the following description, appended claims, and accompanying drawings where the single FIGURE is a side perspective from the rear showing in detail a device embodying features of the present invention

DETAILED DESCRIPTION OF THE PREFERRED EMBODIMENTS

Figure 1:
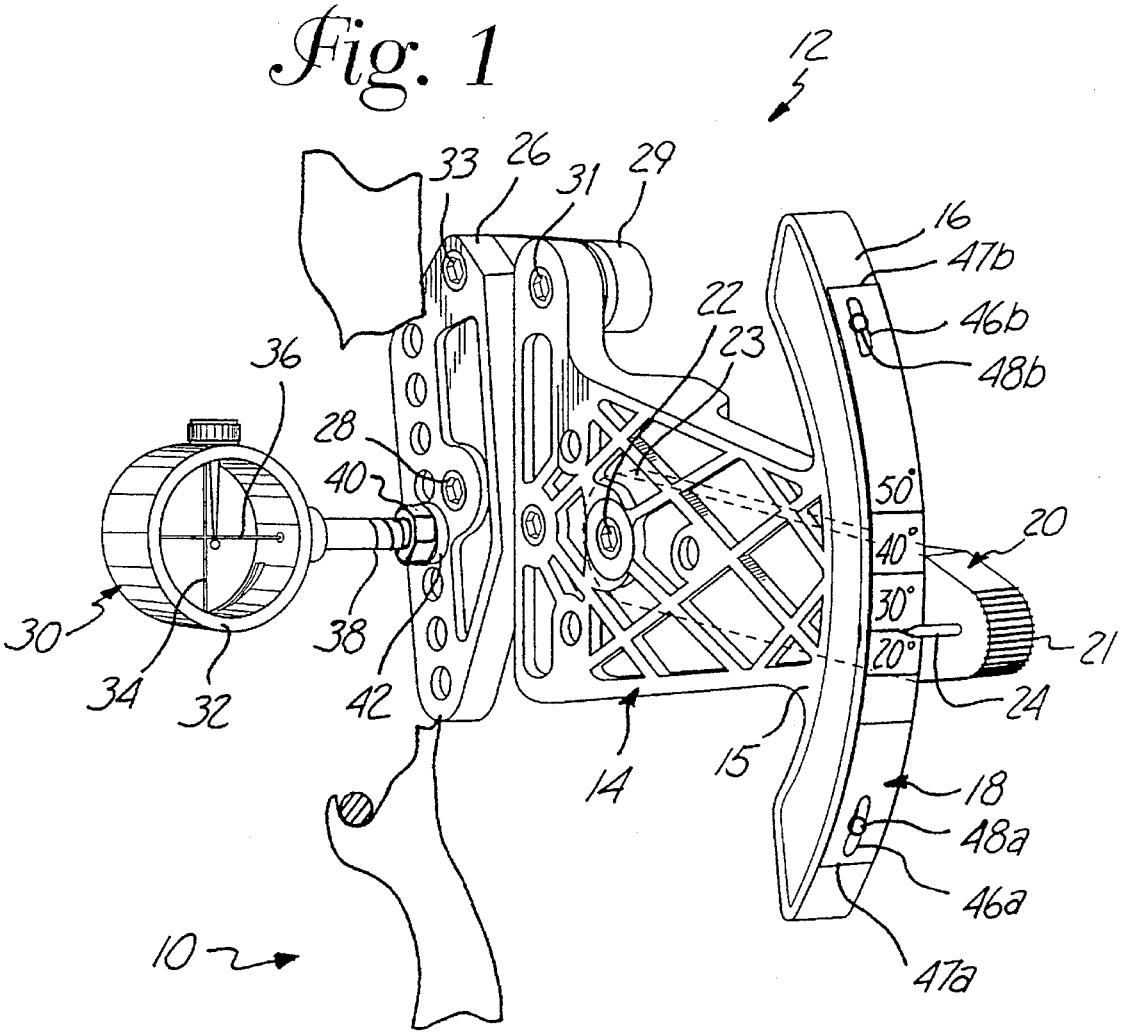

Referring now to the drawing, there is illustrated a bow, partially broken away and generally identified by the numeral 10, on which there is mounted a sighting device in accordance with the present invention, the sighting device being generally identified by the numeral 12. The sighting device 12 preferably includes a support 14 which is elongated. The support 14 carries at its rear end 15 an arcuate member 16 which is provided on the rear surface or rear face with a gauge 18 suitable for calibration with indicia indicating the distance to a target. The gauge 18 is adjustably mounted to the arcuate member 16.

An elongated lever 20 has an intermediate portion pivotally mounted to the support 14 by means of a fastener 22 such as a screw or a hollow rivet. The lever 20 has a rear end 21 which extends rearwardly beyond the arcuate member 16 and the gauge 18 and which carries a pointer 24. The pointer 24 is aligned with, and cooperable with, the gauge 18.

The lever 20 has a front portion 23 on which there is pivotally mounted a carrier plate 26 by way of a fastener 28 such as a screw. The carrier plate is movably mounted relative to support 14 by link 29 which is pivotally coupled to support 14 at pivot 31 and to carrier plate 26 at pivot 33. The carrier plate 26 carries with it a sight unit generally identified by reference numeral 30. The sight unit 30 includes a ring member 32 which has mounted therein vertical and horizontal cross hairs 34, 36. The ring member 32 is carried by a threaded rod 38 which has one end fixed to the ring member 32, and which has the opposite end threaded into a bore in the carrier plate 26. The sight unit 30 is locked in an adjusted angular position relative to the carrier plate 26 by means of a pair of locking nuts 40 and associated washers 42 (only one of which is shown in the FIGURE, the other being opposingly disposed on the opposite side of plate 26).

The lever 20 is locked into an adjusted position to the support 14 preferably at the arcuate member 16 by means of a fastener (not shown) such as a thumb screw which releasably secures lever 20 to support 14. The fastener is loosened when adjustment of the sight unit 30 to accuracy for another distance is desired. The lever 20 is moved in a manner depending on the required adjustment. When the sight unit 30 is adjusted to the desired target distance, the fastener is again tightened down.

The relationship of the lever 20, the support 14, and the carrier plate 26 is preferably one wherein for a uniform movement of the pointer 24 relative to the gauge 18 in an increased target distance direction, there will be a progressive increase in the movement of the sight unit 30 to compensate for the effect of gravity on an arrow travelling the increased target distance. The support 14 effects a tilting of the carrier plate 26 relative to the lever 20 such that the sight unit 30 is tilted relative to the bow 10 so that the sight unit 30 always lies in a plane normal to the line of sight between the sight unit 30 and a target.

The sighting device 12 is preferably constructed so as to prevent light reflection, and may be black. The gauge 18 is preferably such as to allow an archer to mark distances thereon. The gauge 18 is preferably constructed from a material that can withstand exposure to the elements and also accept lasting markings thereon. Such material includes aluminum and polymeric or polymeric composite materials. The markings may be made with an indelible fine-point marker which may be removed with a cotton swab and a mild solvent when recalibrating the gauge, but the markings will not be affected by rain or other moisture. It has also been found that marking aluminum with an indelible marker provides adequately weather resistant markings removable with a common pencil eraser.

The gauge 18 comprises preferably two slots 46*a*, 46*b* proximate the ends 47*a* and 47*b* of the gauge 18. The width of the gauge 18 is preferably the width of the arcuate member 16, approximately 5/16" (or 8 mm). The length of the gauge 18 is approximately 4" (or 102 mm). The slots 46*a*, 46*b* are preferably centered on the width of the gauge 18 and ⅛" (or 3 mm) from each end. Preferably, the slots are ⅝" (or 16 mm) long and ⅛" (or 3 mm) wide. Gauge 18 is preferably mounted so that it is centered on arcuate member 16.

In the preferred embodiment shown in the FIGURE, the gauge 18 is locked into an adjusted position to the arcuate member 16 by means of two fasteners 48*a*, 48*b* such as screws threadably mating with the arcuate member 16. In a preferred embodiment, the fasteners 48*a* and 48*b* are self-tapping screws or screws which mate with threads tapped into arcuate member 16. The fasteners 48*a*, 48*b* are loosened when it is desired to adjust the gauge 18 to correspond with a different arrow point (or for any other reason adjustment is required) and the gauge 18 is moved relative to the arcuate member 16 in a manner depending on the required adjustment. When the gauge 18 is adjusted, the fasteners 48*a*, 48*b* are again tightened down.

It is believed that the difference in flight characteristics of various arrow types is substantially a linear relationship. For example, it is believed that the distance of travel of an arrow using a field tip is linearly related to the distance of travel of an arrow using a broadhead. Thus, the archer need only calibrate distances for the first type of arrow point and one distance for each of the other types of arrow points to determine the linear relationships. The archer, when switching between arrow points need only loosen fasteners 48*a* and 48*b* and adjust the position of gauge 18 on arcuate member 16 by sliding the gauge 18 as fasteners 48*a* and 48*b* travel within slots 46*a* and 46*b* to the adjusted position corresponding to the linear translation and the gauge 18 is automatically recalibrated.

For example, if an archer has calibrated the gauge 18 for a field point and would like to switch to using a broadhead point, the archer need only know that, for instance, 40 yards for a field point translates to approximately 45 yards for broadhead point. Then the archer would take a few practice shots from the 40 yard position from the target. If the archer hits his or her desired target the archer would adjust the gauge 18 so that the 40 yard indicator on the gauge is beneath the pointer 24. When the archer would like to resume using the field tip, he or she need only reverse the process described above.

While the present invention is described with slots 46*a* and 46*b* defined by gauge 18, it should be noted that the slots could be disposed in the face of arcuate member 16 and gauge 18 can include an aperture through which a fastener is inserted to cooperate with the slots in arcuate member 16. It should also be noted that, instead of slots, either gauge 18 or the face of arcuate member 16, or both, can be provided with a series of apertures through which the fasteners can be inserted in order to accomplish repositioning and adjustment of gauge 18 with respect to arcuate member 16.

Although the present invention has been described with reference to preferred embodiments, workers skilled in the art will recognize that changes may be made in form and detail without departing from the spirit and scope of the invention.

What is claimed is:

1. An apparatus suitable for use as an adjustable sight for an archery bow used with an arrow, the apparatus comprising:

a support member fixedly mounted to the archery bow, the support member having a support front end and a support rear end;

a second member at the support rear end, the second member having a face;

a plate adjustably mounted to the face of the second member, the plate receiving removable marking calibrations, each calibration corresponding to a different target distance, the plate being slidable along the face of the second member to accomplish adjustment of the plate, wherein adjustment of the plate for a single marking calibration for its target distance causes corresponding adjustment of a remainder of the marking calibrations, so that the remainder of the marking calibrations are simultaneously calibrated for their respective target distances;

means for locking the plate to the face of the second member in an adjusted position;

a lever having an intermediate portion pivotally mounted to the support member, a lever front end, and a lever rear end, the lever rear end carrying a pointer cooperating with the plate; and a sight unit connected to the lever proximate the lever front end such that for a uniform movement of the pointer along the plate towards an increased target distance position there is movement of the sight unit to compensate for the increase in effect of gravity due to the increased target distance.

2. The apparatus of claim 1 wherein the movement of the sight unit is a progressive increase in movement for a uniform movement of the pointer along the plate.

3. The apparatus of claim 1 wherein the second member is an arcuate member.

4. The apparatus of claim 3 wherein the second member is integral with the support member.

5. The apparatus of claim 3 wherein the plate defines at least one slot therein, and wherein the locking means comprises:

a locking member insertable within the slot to engage the arcuate member to releasably lock the plate to the arcuate member, the slot having a length to allow adjustment of the plate relative to the arcuate member.

6. The apparatus of claim 5 wherein the locking means comprises a set of threads tapped into the arcuate member, and wherein the locking member comprises a screw insertable through the slot and into the threads for locking the plate to the arcuate member in the adjusted position.

7. The apparatus of claim 6 and further comprising a plurality of slots in the plate cooperable with a plurality of sets of threads in the arcuate member, and corresponding screws.

8. The apparatus of claim 1 wherein the plate is formed of a weather resistant material.

9. The apparatus of claim 8 wherein the plate is constructed from aluminum.

10. The apparatus of claim 8 wherein the plate is constructed from a polymeric material.

11. The apparatus of claim 1 wherein the plate is adjustable to compensate for changes in arrow trajectory of a plurality of arrow types.

* * * * *